United States Patent [19]

Buchman

[11] 4,261,058

[45] Apr. 14, 1981

[54] COMFORTER-ROBE

[75] Inventor: Alex Buchman, New York, N.Y.

[73] Assignee: Barclay Home Products, Inc., New York, N.Y.

[21] Appl. No.: 897,187

[22] Filed: Apr. 17, 1978

[51] Int. Cl.[3] ..... A41B 1/12

[52] U.S. Cl. ..... 2/69.5; D2/25

[58] Field of Search ..... 2/69.5, 70, 80, 84, 2/69; 5/343; D2/25

[56] References Cited

U.S. PATENT DOCUMENTS

| | | | |
|---|---|---|---|
| 536,383 | 3/1895 | Huyck | 2/69.5 |
| 1,454,541 | 5/1923 | Falvey | 2/69 |
| 1,661,768 | 3/1928 | Marshall | 2/69 |
| 1,940,224 | 12/1933 | Munro | 2/69 |
| 2,701,885 | 2/1955 | Turco | 2/69.5 |

*Primary Examiner*—Doris L. Troutman

*Attorney, Agent, or Firm*—Friedman, Goodman & Teitelbaum

[57] ABSTRACT

A comforter-robe having a blanket-like body member is provided with a closure member for enclosing a lower portion thereof so that one lower side edge is secured to a corresponding opposite lower side edge. A snap fastener is disposed at each upper corner for attachment to associated snap fasteners disposed adjacent to but slightly above the closure member on the side edges so that the upper half side edges can be held in a folded condition to provide a pair of sleeve portions on the body member, each sleeve portion having a predetermined maximum sleeve opening. At least two additional snap fasteners are disposed at intermediate positions on each upper half side edge for securement together to obtain a preselected sleeve opening smaller than the maximum sleeve opening. Preferably, several snap fasteners are disposed along the top edge of the body member for engagement therebetween to enclose the body member around the wearer's chest. Furthermore, the bottom edge of the body member may be either sewn together or secured together by snaps to define a sack-line configuration.

1 Claim, 7 Drawing Figures

COMFORTER-ROBE

BACKGROUND OF THE INVENTION

The present invention relates to a blanket-like wrap for men, women, and children which may be used as a body enclosing comforter and robe, and more particularly to a comforter-robe which is provided with closure or fastening means disposed along the edges thereof to provide a body covering having sleeve portions thereon, where the sleeve openings are adjustable to a preselected size.

Comforter-robe garments are well known in the art, as shown in U.S. Pat. Nos. 536,383, 1,346,320 and 2,701,885 to name just a few of such patents. These garments provide warmth and comfort, while allowing the user to sit in an upright position and perform manual activity, read and the like. However, though these patents disclose sleeve portions, these prior art sleeve portions have large openings where no provision is provided for reducing the sleeve openings to a smaller preselected size. Accordingly, these prior art large openings permit cold air to penetrate into the garment and also cause the garment to be quite bulky and unmanageable at the sleeve openings.

SUMMARY OF THE INVENTION

Accordingly, it is an object of the present invention to provide a comforter-robe which overcomes the disadvantages of the prior art.

Another object of the present invention is to provide a comforter-robe which allows the wearer to have greater mobility with his hands and arms.

A further object of the present invention is to provide a comforter-robe which includes adjustment means for regulating the size of the sleeve openings.

A still further object of the present invention is to provide a comforter-robe which is simple in construction and can be easily and economically manufactured.

And yet another object of the present invention is to provide a comforter-robe in which the wearer can easily enclose his body therein while permitting quick removal thereof, where the comforter-robe allows the wearer's hands to be exposed for free movement thereof.

The structure of the present invention includes a comforter-robe having a blanket-like body member provided with closure means for enclosing a lower portion thereof with one lower side edge being secured to a corresponding opposite lower side edge. Snap fastener means are disposed at each upper corner for attachment to associated snap fastener means which are disposed adjacent to but slightly above the closure means on the side edges, whereby the upper half side edges are held in a folded condition to provide a pair of sleeve portions on the body member, each sleeve portion having a predetermined maximum sleeve opening. Additional snap fastener means are disposed at intermediate positions on each upper half side edge for engagement with each other to obtain a preselected sleeve opening smaller than the maximum sleeve opening. Other snap fastener means are disposed along the top edge of the body member for engagement therebetween to enclose the body member around the wearer's chest. The bottom edge of the body member may be either sewn together or secured together by snap means to provide a sack-like configuration.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

DETAILED DESCRIPTION OF THE PREFERRED EMBODIMENT

Figure 1:
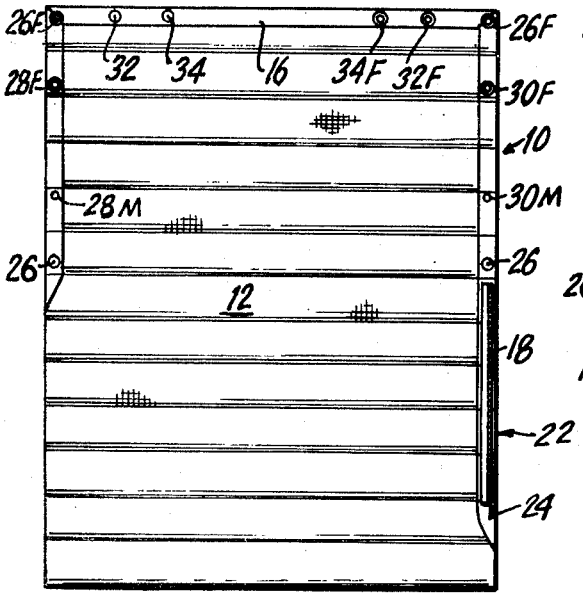
FIG. 1 is an elevational view showing the inside surface of the comforter-robe according to the present invention.
Figure 2:
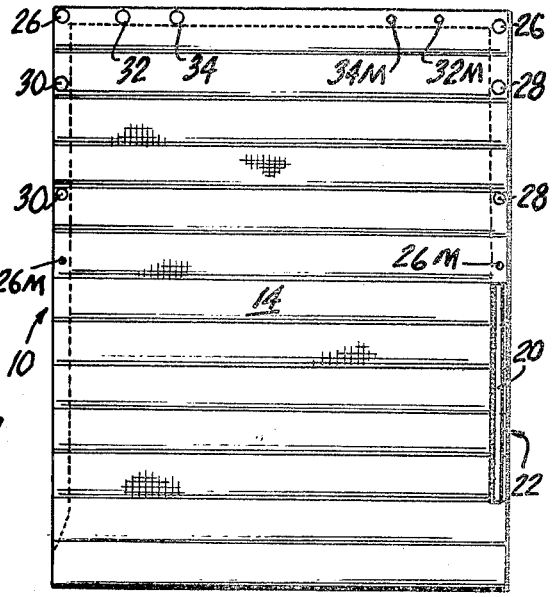
FIG. 2 is an elevational view showing the outside surface of the comforter-robe.

Referring to the drawings, FIGS. 1 and 2 illustrate the comforter-robe 10 in a planar arrangement to show the inner surface 12 and the outer surface 14 thereof. The comforter-robe 10 has a blanket construction, which is preferably quilted and filled with conventional insulation to define a comforter type construction. Preferably, a hem 16 is provided on the inside top edge and also along at least part of the side edges for a proper finish to enhance the appearance thereof. Zipper stringers 18, 20 are secured by conventional means, such as stitching, to opposite side edge portions on the inside surface 12 and outside surface 14 respectively to provide a zipper fastener 22 having a conventional zipper clasp 24. The zipper fastener 22 is spaced from the bottom edge of the comforter-robe 10 and extends upwardly to a point slightly above the lower half of the body member of the comforter-robe 10, as will be explained more fully hereinafter below.

The upper half of the comforter-robe 10 is provided with sets of snap fasteners disposed along the top edge and side edges thereof. Accordingly, a female snap portion 26F is disposed in each upper corner and extends outwardly from the inside surface 12 for snap engagement with an associated one of the male snap portions 26M which extend outwardly from the outside surface 14 to define a set of snap fasteners 26. The male snap portions 26M are disposed on opposite side edges adjacent to but above the zipper stringers 18, 20 respectively.

Other sets of snap fasteners 28, 30 are disposed on opposite sides along the side edges between the snap portions 26F and 26M. The male and female snap portions 28M, 30M and 28F, 30F extend outwardly from the inside surface 12, with the female snap portion 28F, 30F being preferably disposed above the male snap portions 28M, 30M.

Further sets of snap fasteners 32, 34 are disposed along the top edge, where the female snap portions 32F, 34F extend outwardly from the inside surface 12 and the male snap portions 32M, 34M extend outwardly from the outside surface 14. Preferably, the female snap portions 32F, 34F are disposed on one side and the male snap portions 32M, 34M are disposed on the opposite side. The function of the above mentioned snap fasteners will be set forth in more detail hereinafter below.

Figure 3:
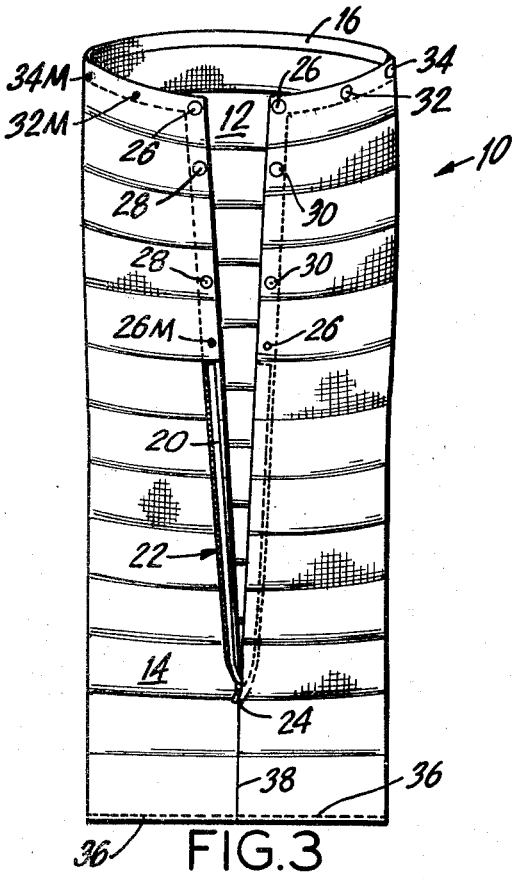
FIG. 3 is an enlarged front perspective view of the comforter-robe in a sack-like configuration prior to being worn.

FIG. 3 shows the comforter-robe 10 having a sack-like configuration with the bottom edge folded on itself in a lapped arrangement secured together by conventional fastening means, such as stitching 36. Additionally, the lowermost side edges between the zipper fastener 22 and the bottom edge are also secured together by conventional fastening means, such as stitches 38 to form a sleeping bag-type arrangement. In this arrangement, the comforter-robe 10 is in condition to receive the wearer thereof. Preferably, the wearer steps into the comforter-robe and pulls the clasp 24 of the zipper fastener 20 to a closed position so that the lower portion of the wearer's body is covered by the closed lower half of the comforter-robe, whereby the wearer may accomplish this procedure in a sitting position where the upper half of the comforter-robe 10 is still open.

Figure 4:
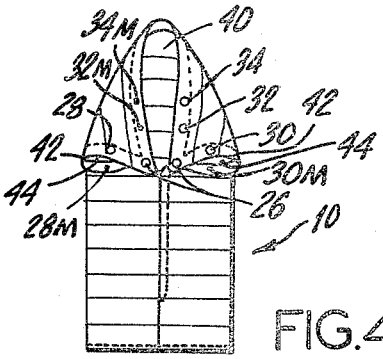
FIG. 4 is a front perspective view of the comforter-robe showing the formation of the sleeve portions thereof.
Figure 5:
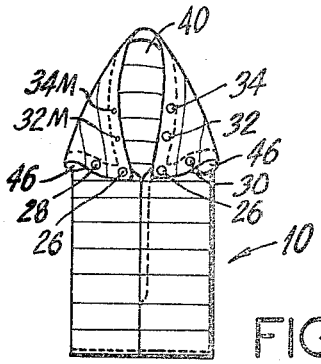
FIG. 5 is a front perspective view similar to FIG. 4 showing the adjustment of the sleeve portions.

Once the wearer is inside the comforter-robe 10, the top corners are pulled over the wearer's shoulders and down the front of his body. The female snap portions 26F are now snapped together with the associated male snap portions 26M to obtain the configuration shown in FIG. 4. This configuration now provides a front opening 40 and a pair of sleeve portions 42, each having a predetermined maximum sleeve opening 44.

Figure 6:
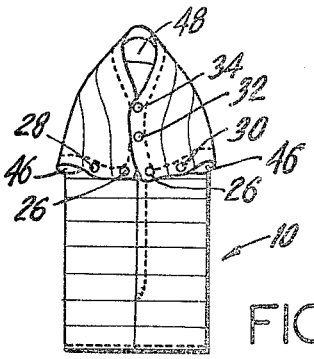
FIG. 6 is a front perspective view similar to FIGS. 4 and 5, showing the chest closure thereof.

The wearer now engages the female snap portions 28F, 30F with the male snap portions 28M, 30M to obtain preselected sleeve openings 46 which are smaller than the above mentioned maximum sleeve openings 44. If desired, the wearer can engage the female snap portions 32F, 34F with the male snap portions 32M, 34M, respectively, to enclose the chest of the wearer as shown in FIG. 6. Thus, an opening 48 smaller than the above mentioned opening 40 is provided so that the wearer's head can extend out of the comforter-robe 10. Additionally, the sleeve openings 46 permit the wearer to extend his hands or arms out of the comforter-robe 10.

Figure 7:
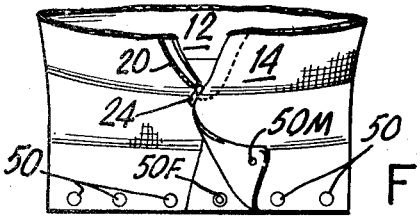
FIG. 7 is a fragmentary perspective view showing a modified bottom closure for the comforter-robe.

FIG. 7 discloses a modified bottom portion of the comforter-robe, whereby sets of snap fasteners 50 secure the bottom edge of the comforter-robe together in a folded lapped arrangement. Accordingly, each snap fastener 50 includes a male snap portion 50M and a female snap portion 50F. Thus, the wearer can either close the bottom edge to enclose his feet therein, or may leave the bottom edge open whereby the wearer can walk while still wearing the comforter-robe 10.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A comforter-robe comprising:

a blanket-like body member having top, bottom and opposite side edges, said bottom edge being secured together by stitching;

closure means for enclosing a lower portion of said body member to at least secure a lower half portion of one side edge to a corresponding lower half portion of the other side edge, said closure means including a zipper fastener;

first fastener means at each upper corner for attachment to associated second fastener means, said second fastener means being respectively disposed on upper half portions of said opposite side edges adjacent to said closure means;

said first and second fastener means positioning each of said upper half portions in a folded condition to define a pair of sleeve portions on said body member, each sleeve portion having a predetermined maximum sleeve opening, said first and second fastener means being snap fasteners;

third fastener means disposed on said top edge of said body member for securing said top edge together around a wearer's chest, said third fastener means being snap fasteners;

adjustment means disposed on each of said upper half portions of said side edges between said first and second fastener means for securing intermediate portions of each upper half portion together to obtain a preselected sleeve opening smaller than said maximum sleeve opening, said ajustment means being snap fasteners; and said snap fasteners of said adjustment means includes male and female snap portions extending outwardly from an inside surface of said body member, said snap fasteners of said first fastener means including female snap portions extending outwardly from said inside surface of said body member, and said snap fasteners of said second fastener means including male snap portions extending outwardly from an outside surface of said body member.

* * * * *